US011873993B1

(12) United States Patent
Fossi

(10) Patent No.: US 11,873,993 B1
(45) Date of Patent: Jan. 16, 2024

(54) COMBUSTOR FOR GAS TURBINE ENGINE WITH CENTRAL FUEL INJECTION PORTS

(71) Applicant: Pratt & Whitney Canada Corp., Longueuil (CA)

(72) Inventor: Alain Athanase Fossi, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/104,978

(22) Filed: Feb. 2, 2023

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01); *F23R 2900/00002* (2013.01)

(58) Field of Classification Search
CPC ..... F23R 3/12; F23R 3/14; F23R 3/28; F23R 3/283; F23R 3/286; F23D 11/103
See application file for complete search history.

(56) References Cited

U.S. PATENT DOCUMENTS

| | | | |
|---|---|---|---|
| 4,854,127 | A | 8/1989 | Vinson et al. |
| 5,218,824 | A | 6/1993 | Cederwall et al. |
| 6,547,163 | B1 | 4/2003 | Mansour et al. |
| 7,065,972 | B2 | 6/2006 | Zupanc et al. |
| 7,832,212 | B2 | 11/2010 | Bunker |
| 7,870,736 | B2 | 1/2011 | Homitz et al. |
| 8,266,911 | B2 | 9/2012 | Evulet |
| 8,413,445 | B2 | 4/2013 | Poyyapakkam |
| 8,539,773 | B2 | 9/2013 | Ziminsky et al. |
| 8,661,779 | B2 | 3/2014 | Laster et al. |
| 8,893,500 | B2 | 11/2014 | Oskam |
| 9,771,869 | B2 | 9/2017 | Li et al. |
| 9,976,522 | B2 | 5/2018 | Patel et al. |
| 10,082,294 | B2 | 9/2018 | Laster et al. |
| 10,267,522 | B2 | 4/2019 | Ciani et al. |
| 10,502,425 | B2 | 12/2019 | Boardman et al. |
| 10,704,786 | B2 | 7/2020 | Laster et al. |
| 10,865,989 | B2 | 12/2020 | Sadasivuni |

(Continued)

FOREIGN PATENT DOCUMENTS

| | | |
|---|---|---|
| CN | 101220955 | 7/2008 |
| CN | 206113000 | 4/2017 |

(Continued)

*Primary Examiner* — Alain Chau
*Assistant Examiner* — Sean V Meiller
(74) *Attorney, Agent, or Firm* — Carlson, Gaskey & Olds, P.C.

(57) ABSTRACT

A combustor includes a liner defining a combustion chamber. An air and fuel mixing body is received within the liner and upstream of the combustion chamber. The mixing body has a center axis and includes a bluff-body. A plurality of fuel injection ports on the bluff-body communicate with a central fuel supply such that fuel passes from the fuel supply passage and into a mixing chamber with a component in an axially downstream direction and a radially outward direction relative to said central axis. A plurality of inner air swirlers provide air into the mixing chamber with a component in an axially downstream direction, a radially outward direction, and with a circumferential component due to swirler structure. The fuel injection ports are downstream of an outlet of the inner air swirlers.

17 Claims, 3 Drawing Sheets

(56) References Cited

U.S. PATENT DOCUMENTS

| | | | | |
|---|---|---|---|---|
| 10,941,940 | B2 | 3/2021 | Bulat et al. | |
| 11,041,624 | B2 * | 6/2021 | Witham | F23D 11/383 |
| 11,067,280 | B2 | 7/2021 | Boardman et al. | |
| 11,378,275 | B2 | 7/2022 | Locke et al. | |
| 11,713,881 | B2 * | 8/2023 | Mishra | F23R 3/14 60/737 |
| 2011/0185703 | A1 | 8/2011 | Dodo et al. | |
| 2012/0227411 | A1 | 9/2012 | Carroni et al. | |
| 2017/0227224 | A1 | 8/2017 | Oskam et al. | |
| 2017/0307210 | A1 | 10/2017 | Hirano et al. | |
| 2021/0172413 | A1 | 6/2021 | Snyder | |

FOREIGN PATENT DOCUMENTS

| | | |
|---|---|---|
| EP | 1923637 | 5/2008 |
| JP | 2013108667 | 6/2013 |
| JP | 5538113 | 7/2014 |
| JP | 5926635 | 5/2016 |
| WO | 2016051756 | 4/2016 |
| WO | 2020259919 | 12/2020 |

* cited by examiner

COMBUSTOR FOR GAS TURBINE ENGINE WITH CENTRAL FUEL INJECTION PORTS

BACKGROUND

This application relates to a combustor wherein a central bluff-body receives fuel injection ports to deliver fuel downstream of an outlet of an inner air swirler.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate a compressor rotor and a propulsor rotor such as a fan or propeller.

Historically, aviation fuel has been utilized with gas turbine engines, especially for aircraft applications. More recently it has been proposed to utilize hydrogen ($H_2$) as a fuel.

SUMMARY

A combustor includes a liner defining a combustion chamber. An air and fuel mixing body is received within the liner and upstream of the combustion chamber. The mixing body has a center axis and includes a bluff-body. A plurality of fuel injection ports on the bluff-body communicate with a central fuel supply such that fuel passes from the fuel supply passage and into a mixing chamber with a component in an axially downstream direction and a radially outward direction relative to said central axis. A plurality of inner air swirlers provide air into the mixing chamber with a component in an axially downstream direction, a radially outward direction, and with a circumferential component due to swirler structure. The fuel injection ports are downstream of an outlet of the inner air swirlers.

These and other features will be best understood from the following drawings and specification, the following is a brief description.

DETAILED DESCRIPTION

Figure 1:
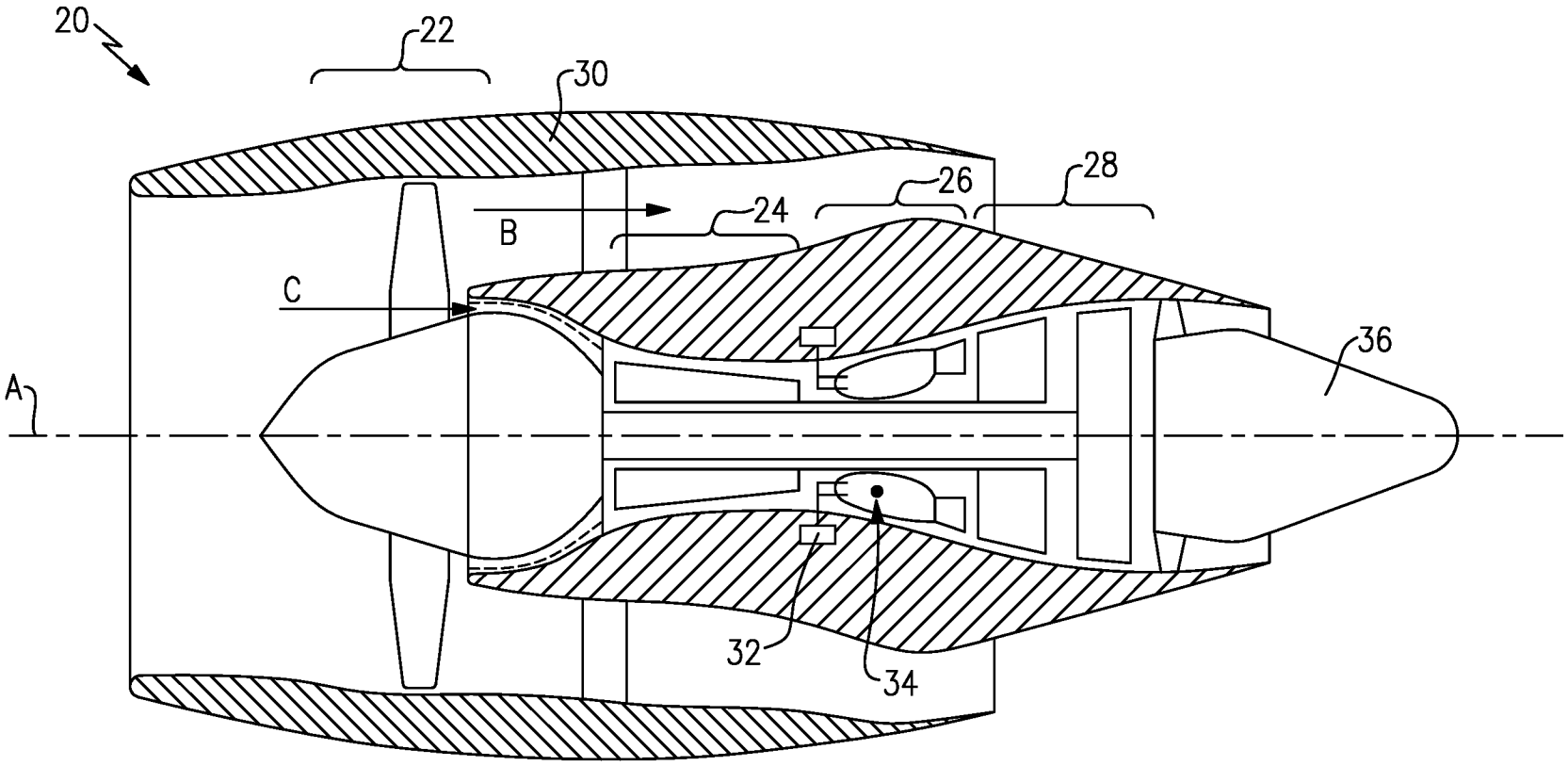
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller.

A gas turbine engine as disclosed in this application will utilize hydrogen ($H_2$) as a fuel. Challenges are faced by the use of hydrogen, and in particular combustor structure which might be appropriate for aviation fuel may not be as applicable to hydrogen as a fuel.

One challenge when utilizing hydrogen as a fuel is that it is in a gaseous state and more readily flammable than aviation fuel. This could raise challenges with burn back if ignitions starts too close to the fuel feed. The higher laminar flame speed of hydrogen compared to aviation fuel might also point to an enhanced flame stabilization mechanism.

Figure 2A:
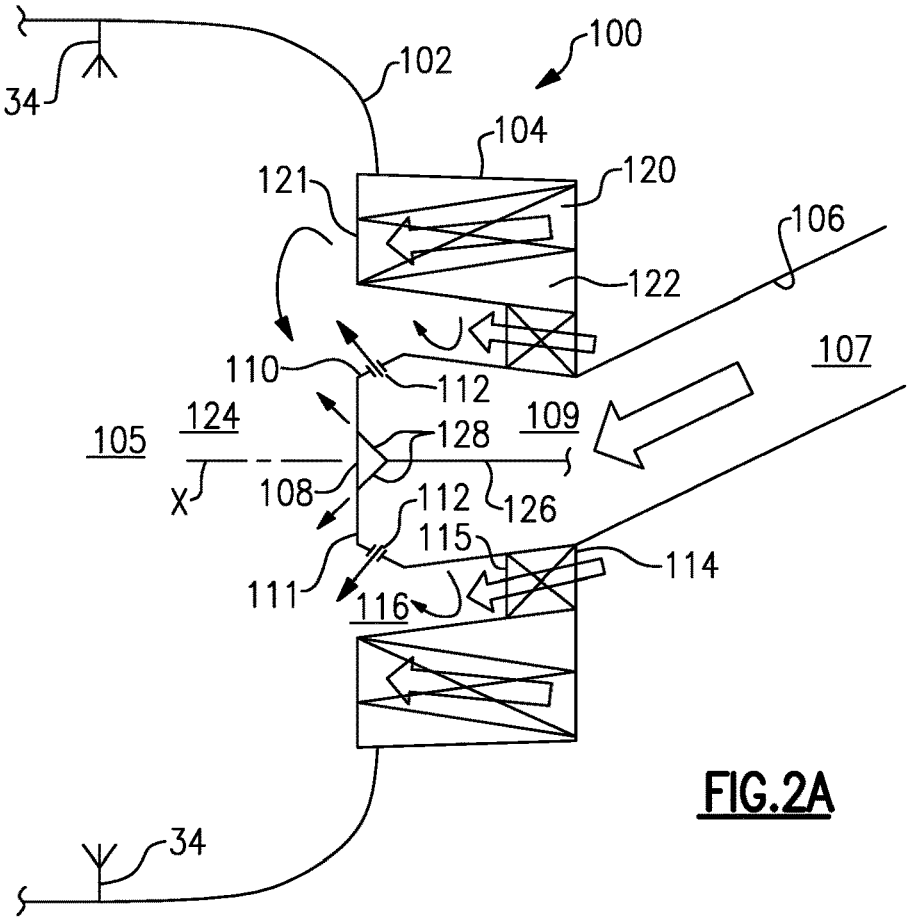
FIG. 2A shows a first embodiment of a portion of the combustor.

FIG. 2A shows a combustor 100 having a liner 102 (shown partially) defining a combustion chamber 105. Ignitors 34 are shown schematically.

An air and fuel mixing body 104 has a fuel feed 106 beginning at a portion 107 and leading to a downstream portion 109 that delivers fuel toward a forward face 108 of a bluff-body 111. The bluff-body 111 enhances flame stabilization. The portion 109 is centered on axis X. Axis X may also be a center axis of mixing body 104.

The fuel exits through fuel ports 112 in frusto-conical portion 110 of bluff-body 111.

Inner air swirler 114 delivers air with a circumferential component and an axially downstream component, along with a radially outward component all relative to the central axis X. As can be appreciated, the inner air swirler has a downstream end 115 leading into a chamber portion 116, and which is upstream of the fuel injection ports 112. The inner air swirler is configured to achieve the radially outward component and the axially downstream component for a majority of the air exiting the inner air swirler 114.

It should be understood that fuel ports 112 are spaced about a circumference of the central axis X.

When the fuel leaves the ports 112, the swirling air in the chamber 116 begins to mix with the fuel. As the air and fuel mix and move further downstream, they encounter an outer air swirler air flow from outer air swirlers 120 which are defined in a body portion 122 of the mixing body 104 positioned radially outwardly of the inner swirler 114.

The fuel injection ports deliver fuel as discrete supplies but into a circumferentially continuous annular channel, allowing fuel to move radially outwardly and into the path of the inner swirler airflow effectively as a sheet instead of a plurality of discrete jets.

The outer air swirlers 120 have a downstream end or outlets 121 which provides air moving with a circumferential component, an axially downstream component, along with a radially inward component all relative to central axis X. That outer swirling air encounters the mixed inner air and fuel and drives all of it downstream toward a portion 124 of the combustor chamber 105. The outer air swirler 120 is configured to achieve the axially downstream component and the radially inward component for a majority of the air exiting the outer air swirler.

The structure of swirlers 114 and 120 may be as known.

By moving the mixed fuel and air downstream into the area forward of the forward face 108 of the bluff-body 111, the risk of burn back reaching the fuel injection ports 112 is reduced.

As shown, a supply of cooling air 126 may be delivered to the forward face 108 of bluff-body 111, and radially inward of the fuel ports 112. The air is shown with a component in a radially outward direction relative to the axis X, and serves to cool the forward face 108.

Figure 2B:
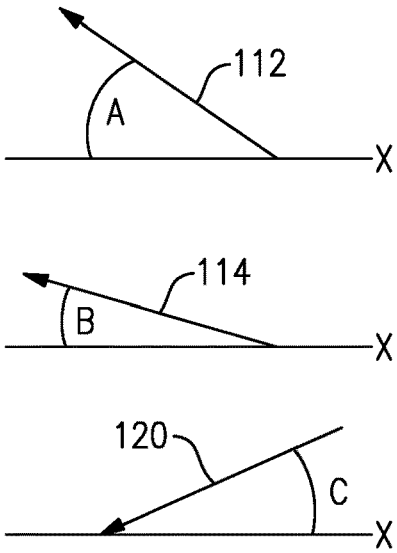
FIG. 2B shows a geometric feature of a mixing body in the FIG. 2A embodiment.

FIG. 2B shows geometric feature of the FIG. 2A embodiment. As shown, the fuel injection ports 112 extend at an angle A with a radially outer component and an axially downstream component.

Similarly, air leaving the inner swirler 114 has a radially outwardly component and in an axially downstream direction and defining an angle B with central axis X.

In contrast, the outer swirler 120 delivers air with a radially inner component in an axially downstream direction and defining an angle C with central axis X.

The combination of these three directions ensure efficient and thorough mixing downstream of the outlet 121.

Figure 3:
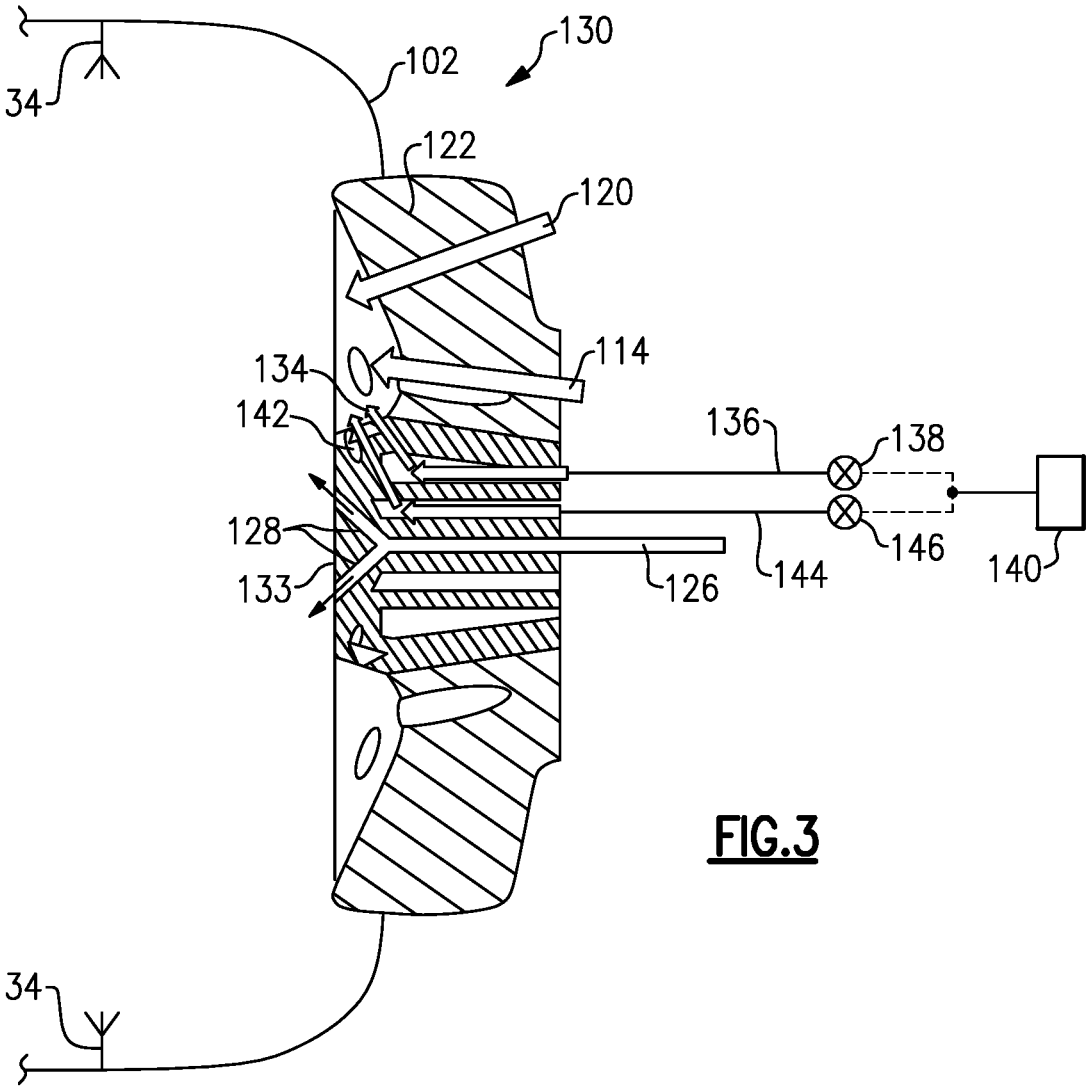
FIG. 3 shows a second embodiment fuel and air mixing body.

FIG. 3 shows another embodiment 130. Here, the forward face 131 of the bluff-body 133 is provided with a first set of fuel injection ports 134 communicating with a first fuel supply line 136 and controlled by a valve 138.

A second group of fuel injection ports 142 communicates with the line 144 having a valve 146. A control 140 is programmed to control valves 138 and 146 and selectively deliver fuel to sets of the fuel injection ports 134 and 142.

One of the valves 138 may be opened to provide a primary or pilot fuel supply such as when ignition is initially beginning. The other valve 146 may control the flow of fuel to line 144 and fuel supply ports 142 as a secondary source of fuel. The secondary source of fuel may be opened at higher fuel flow conditions such as takeoff or cruise.

The control 140 may be a standalone electronic controller, or it could be incorporated into a full authority digital electronic controller (FADEC) for the entire associated gas turbine engine.

The time when fuel should be supplied between the two supplies may be as known in the art. However, the use of the unique arrangement in the air fuel mixing body 132 in this embodiment provides more efficient mixing of the fuel and air under either condition.

Again, a supply of cooling air 126 delivers air to ports 128 at the forward face 131.

Figure 4:
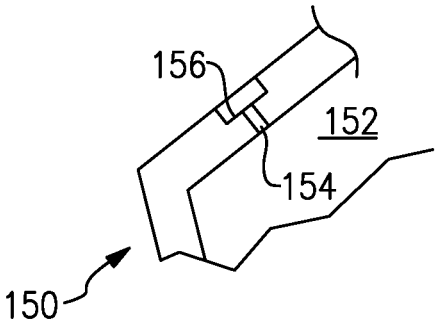
FIG. 4 shows an optional fuel injection feature.

FIG. 4 shows an embodiment 150 wherein the fuel supply 152 leads to a plurality of fuel injection ports 154 extending radially outwardly an into an annular channel 156. Now, the plurality of the fuel injection ports 154 deliver fuel as discrete supplies but into a circumferentially continuous annular channel 156. Thus, the fuel will move radially outwardly and into the path of the inner swirler airflow effectively as a sheet instead of a plurality of discrete jets.

In a featured embodiment, a combustor 100/130 under this disclosure could be said to include a liner 102 defining a combustion chamber 105. An air and fuel mixing body 104/132 is received within the liner and upstream of the combustion chamber. The mixing body has a center axis X, and within a bluff-body 111/132. A plurality of fuel injection ports 112/134/142 are drilled in the bluff-body such that fuel passes from the fuel supply passage and into a mixing chamber with a component in an axially downstream direction and a radially outward direction relative to the central axis. A plurality of inner air swirlers 114 provide air into a mixing chamber with a component in an axially downstream direction, a radially outward direction, and with a circumferential component due to swirler structure. The fuel injection ports are downstream of an outlet 115 of the inner air swirlers 114.

In another embodiment according to the previous embodiment, a fuel supply is connected to the central fuel supply and the fuel supply being hydrogen.

In another embodiment according to any of the previous embodiments, a generally frusto-conical portion 110 of the bluff-body axially upstream of a forward face receives the fuel injection ports.

In another embodiment according to any of the previous embodiments, a plurality of outer air swirlers 120 delivers air into the combustion chamber 105, and downstream of the mixing chamber.

In another embodiment according to any of the previous embodiments, air is delivered downstream of the plurality of outer air swirlers with a component in an axially downstream direction, a radially inward direction and with a circumferential component due to swirler structure.

In another embodiment according to any of the previous embodiments, there are at least two fuel supply passages 136/144 with at least one of said at least two fuel supply passages being provided with a valve 138/146 controlled by a controller 140. The controller is operable to selectively deliver fuel from each of said at least two fuel supply passages to associated ones of said fuel injection ports 134/142 dependent on operational conditions.

In another embodiment according to any of the previous embodiments, the plurality of fuel injection ports lead into a common circumferentially continuous channel 156.

In another embodiment according to any of the previous embodiments, a plurality of outer air swirlers 120 delivers air into the combustion chamber 105, and downstream of the mixing chamber.

In another embodiment according to any of the previous embodiments, air is delivered downstream of the plurality of outer air swirlers with a component in an axially downstream direction, a radially inward direction and with a circumferential component due to swirler structure.

In another embodiment according to any of the previous embodiments, a cooling air supply 126 is connected to the bluff-body, and for delivering cooling air to a forward face of the bluff-body.

A gas turbine engine incorporating any of the above features is also disclosed and claimed.

Although embodiments have been disclosed, a worker of skill in this art would recognize that modifications would come within the scope of this disclosure. For that reason, the following claims should be studied to determine the true scope and content of this disclosure.

What is claimed is:

1. A combustor comprising:

a liner defining a combustion chamber;

an air and fuel mixing body received within said liner and upstream of the combustion chamber; the mixing body has a center axis and includes a bluff-body;

a plurality of fuel injection ports on the bluff-body and communicating with a central fuel supply such that fuel passes from the fuel supply passage and into a mixing chamber with a component in an axially downstream direction and a radially outward direction relative to said central axis;

a plurality of inner air swirlers providing air into the mixing chamber with a component in an axially downstream direction, a radially outward direction, and with a circumferential component due to swirler structure; and the fuel injection ports being downstream of an outlet of the inner air swirlers, wherein a plurality of outer air swirlers delivers air into the combustion chamber, and downstream of the mixing chamber, and wherein air is delivered downstream of the plurality of outer air swirlers with a component in an axially downstream direction, a radially inward direction and with a circumferential component due to swirler structure, wherein the plurality of outer swirlers are inwardly angularly offset from the center axis, and the plurality of inner air swirlers are outwardly angularly offset from the center axis.

2. The combustor as set forth in claim 1, wherein a fuel supply is connected to the central fuel supply and the fuel supply being hydrogen.

3. The combustor as set forth in claim 1, wherein there are at least two fuel supply passages with at least one of said at least two fuel supply passages being provided with a valve controlled by a controller, and said controller being operable to selectively deliver fuel from each of said at least two fuel supply passages to associated ones of said fuel injection ports in the bluff-body dependent on operational conditions.

4. The combustor as set forth in claim 3, wherein a generally frusto-conical portion of the bluff-body axially upstream of a forward face receives the fuel injection ports.

5. The combustor as set forth in claim 4, wherein a plurality of outer air swirlers delivers air into the combustion chamber, and downstream of the mixing chamber.

6. The combustor as set forth in claim 1, wherein said plurality of fuel injection ports lead into a common circumferentially continuous channel.

7. The combustor as set forth in claim 1, wherein a cooling air supply is connected to the bluff-body, and for delivering cooling air to a forward face of the bluff-body.

8. The gas turbine engine as set forth in claim 1, the inner air swirlers are configured to achieve the radially outward component and the axially downstream component for the majority of the air exiting the inner air swirlers and the outer air swirlers are configured to achieve the axially downstream component and the radially inward component for a majority of the air exiting the outer air swirlers.

9. A combustor comprising:

a liner defining a combustion chamber;

an air and fuel mixing body received within said liner and upstream of the combustion chamber;

the mixing body has a center axis and includes a bluff-body;

a plurality of fuel injection ports on the bluff-body and communicating with a central fuel supply such that fuel passes into a mixing chamber with a component in an axially downstream direction and a radially outward direction relative to said central axis;

a plurality of inner air swirlers providing air into the mixing chamber with a component in an axially downstream direction, a radially outward direction, and with a circumferential component due to swirler structure;

the fuel injection ports being downstream of an outlet of the inner air swirler wherein a plurality of outer air swirlers delivers air into the combustion chamber, and downstream of the mixing chamber;

wherein air is delivered downstream of the plurality of outer air swirlers with a component in an axially downstream direction, a radially inward direction and with a circumferential component due to swirler structure;

the inner air swirlers are outwardly angularly offset from the center axis and are configured to achieve the radially outward component and the axially downstream component for a majority of the air exiting the inner air swirlers; and the outer air swirlers are inwardly angularly offset from the center axis and are configured to achieve the axially downstream component and the radially inward component for a majority of the air exiting the outer air swirlers.

10. A gas turbine engine comprising:

a compressor section and a turbine section with a combustor intermediate the compressor section and the turbine section;

the combustor having a liner defining a combustion chamber, an air and fuel mixing body received within said liner and upstream of the combustion chamber;

the mixing body has a center axis, and includes a bluff-body;

a plurality of fuel injection ports on the bluff-body and communicating with a central fuel supply such that fuel passes from the fuel supply passage and into a mixing chamber with a component in an axially downstream direction and a radially outward direction relative to said central axis;

a plurality of inner air swirlers providing air into the mixing chamber with a component in an axially downstream direction, a radially outward direction, and with a circumferential component due to swirler structure, the inner air swirlers being outwardly angularly offset from the center axis and are configured to achieve the radially outward component and the axially downstream component for a majority of the air exiting the inner air swirlers; and the fuel injection ports being downstream of an outlet of the inner air swirlers wherein a plurality of outer swirlers delivers air into the combustion chamber downstream of the mixing chamber, wherein said plurality of outer swirlers are inwardly angularly offset from the center axis, wherein air is delivered downstream of said plurality of outer air swirlers with a component in an axially downstream direction, a radially inward direction and with a circumferential component due to swirler structure, the outer air swirlers are configured to achieve the axially downstream component and the radially inward component for a majority of the air exiting the outer air swirlers.

11. The gas turbine engine as set forth in claim 10, wherein a fuel supply is connected to the central fuel supply and the fuel supply being hydrogen.

12. The gas turbine engine as set forth in claim 10, wherein there are at least two fuel supply passages with at least one of said at least two fuel supply passages being provided with a valve controlled by a controller, and said controller being operable to selectively deliver fuel from each of said at least two fuel supply passages to associated ones of said fuel injection ports in the bluff-body dependent on operational conditions.

13. The gas turbine engine as set forth in claim 12, wherein a generally frusto-conical portion of the bluff-body axially upstream of a forward face receives the fuel injection ports.

14. The gas turbine engine as set forth in claim 10, wherein said plurality of fuel injection ports lead into a common circumferentially continuous channel.

15. The gas turbine engine as set forth in claim 10, wherein a plurality of outer swirlers delivers air into the combustion chamber, and downstream of the mixing chamber.

16. The gas turbine engine as set forth in claim 15, wherein air is delivered downstream of said plurality of outer air swirlers with a component in an axially downstream direction, a radially inward direction and with a circumferential component due to swirler structure.

17. The gas turbine engine as set forth in claim 10, wherein a cooling air supply is connected to the bluff-body, and for delivering cooling air to a forward face of the bluff-body.

* * * * *